United States Patent [19]

Spetalnik

[11] 4,165,797

[45] Aug. 28, 1979

[54] ADJUSTABLE HIGH FREQUENCY SOUND DISPERSION SYSTEM

[76] Inventor: Mack Spetalnik, 25 Arthur Dr., Rutherford, N.J. 07070

[21] Appl. No.: 897,663

[22] Filed: Apr. 19, 1978

Related U.S. Application Data

[63] Continuation-in-part of Ser. No. 803,648, Jun. 6, 1977, abandoned.

[51] Int. Cl.[2] ..... H04R 1/40

[52] U.S. Cl. ..... 181/147; 181/154

[58] Field of Search ..... 179/1 E; 181/144, 145, 181/146, 147, 154

[56] References Cited

FOREIGN PATENT DOCUMENTS

| | | | |
|---|---|---|---|
| 165502 | 8/1949 | Austria | 181/144 |
| 1303602 | 1/1973 | United Kingdom | 179/1 E |

OTHER PUBLICATIONS

Bozak Promotional Pamphlet No. 25M/1074, Printed no later than Feb. 6, 1975.

*Radio Electronics*, Apr. 1957, p. 46.

Janszen Promotional Sheet on 130 Series, Printed no later than Feb. 6, 1975.

*Primary Examiner*—George G. Stellar

*Attorney, Agent, or Firm*—Constantine A. Michalos

[57] ABSTRACT

A loudspeaker system providing multi-directional sound distribution throughout all listening areas of a room. The system includes a housing with at least four high frequency loudspeakers arranged symmetrically about the center of the front section. High frequency sound is beamed from the loudspeakers at pre-determined angle toward the walls, floor, and ceiling of a room in order to optimize sound dispersion throughout the room. Each inclined panel is pivotally mounted to the housing and the housing includes an adjustment means for varying the incline of the panel. The loudspeaker system can thus be adjusted to disperse sound in a desired pattern which is selected depending on the shape of the room. The room may thus be fully saturated with high frequency sound which is normally directional in nature.

3 Claims, 7 Drawing Figures

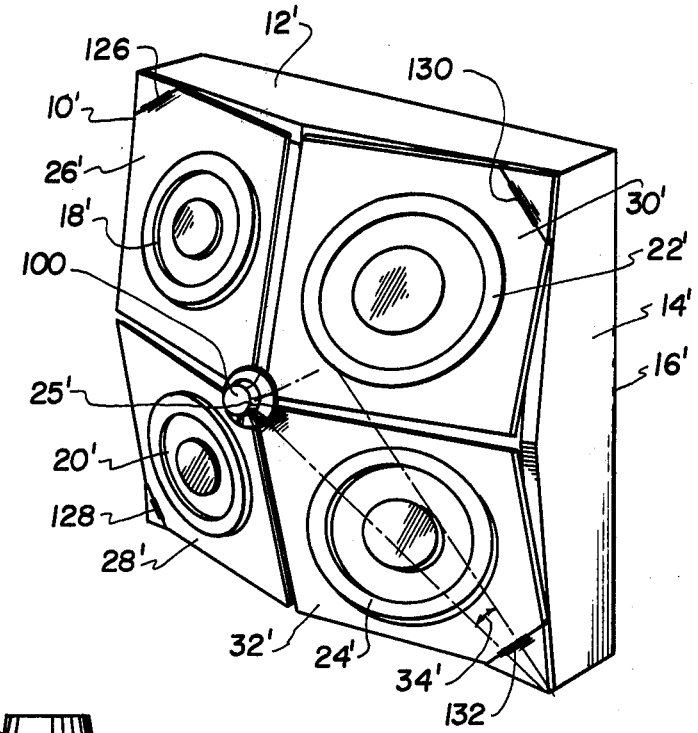
FIG. 4
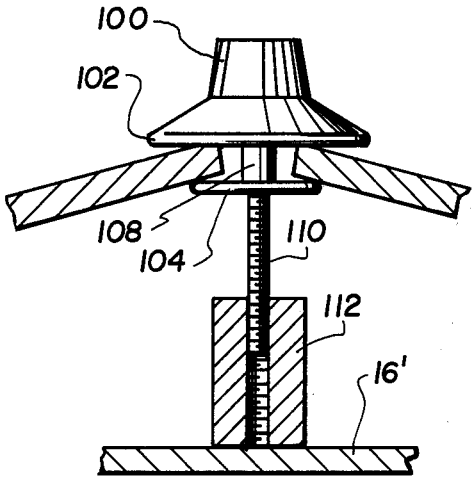
FIG. 5
FIG. 6a
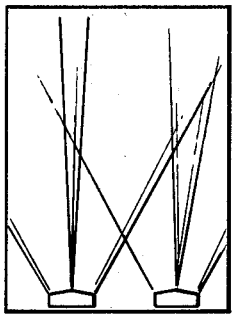
FIG. 6b
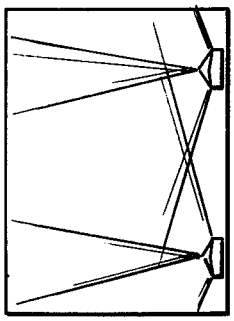

ADJUSTABLE HIGH FREQUENCY SOUND DISPERSION SYSTEM

This is a continuation in part application of application Ser. No. 803,648 filed June 6, 1977, and now abandoned.

BACKGROUND OF THE INVENTION

1. Field of the Invention

The present invention generally relates to loudspeaker systems and more particularly to multiple loudspeakers arranged in a housing to provide omnidirectional sound radiation of high frequencies.

2. Description of Prior Art

Previously, a difficult problem in sound reproduction systems has been the poor dispersion characteristic of high frequency sound waves above 3000 hertz. At these high frequencies sound radiates in a relatively narrow beam from a loudspeaker so that different areas in a room receive uneven amounts of sound intensity. This effect causes an imbalance between the radiation patterns of high frequency and low frequency sound which impairs the enjoyment of high fidelity music reproduction.

Although previous loudspeaker systems have attempted to overcome this problem by use of multiple speakers or specially built tweeters, they have not been able to achieve an economical loudspeaker system which yielded an efficient high frequency wide dispersion characteristic.

The present invention solves this problem to a large extent by the use of at least four angularly positioned tweeter loudspeakers in a uniquely structured enclosure so that high frequency sound is scattered uniformly, and reflected from the walls, floor, and ceiling of a room, having a resultant sound vector that is in a balanced relationship with low frequency sound.

SUMMARY

The present invention provides a wide dispersion characteristic for high frequency sound utilizing a unique loudspeaker system. At least four tweeter loudspeakers are arranged symmetrically about the specially constructed unit which is mounted on the front section of the loudspeaker enclosure. Each of these hi-frequency loudspeakers is mounted on a panel so inclined at a critical angle, from the center of the grouping. In one embodiment of the invention the panels have a rhomboidal shape so that the enclosure may be reduced to an optimum size. In another embodiment of the invention an additional tweeter loudspeaker is mounted on a centrally located panel that is parallel to the rear planar wall of the enclosure.

The wide dispersion characteristic of high frequency sound, over 3000 hertz, is achieved by directing the narrow beam of sound waves radiating from at least four tweeter loudspeakers throughout the listening area both horizontally and vertically as well as at wide angles. In this manner high frequency sound is dispersed and diffused to all parts of the room.

In another embodiment of the invention each panel is hinged or pivotally mounted to a loudspeaker enclosure and an adjustment device is connected to the panels for varying the incline thereof. The incline of the panels can be adjusted to disperse sound throughout an entire room regardless of the shape of the room. The angle of the incline is selected so that the normally directional high frequency sound totally disperses within the room minimizing or canceling entirely the dead space areas of the room.

Accordingly, a major object of this invention is to provide a loudspeaker system for dispersing high frequency sound at a balanced intensity to all listening areas of a room.

Another object of this invention is to provide a smooth frequency response to various parts of an average room.

Still another object of this invention is to reproduce music so accurately that it will closely simulate live performance.

A still further object of the present invention is to provide a high frequency sound total dispersion system comprising, a housing having a front section with at least four interconnected non-isoplanar panels mounted symmetrically about the center of said front section, sidewalls, a rear planar wall opposite said front section, at least one tweeter loudspeaker mounted in each of said front section panels, at least four of said non-isoplanar panels are inclined at an acute angle with respect to a plane parallel with said rear planar wall, each of said inclined panels sloping away from the center of said front section.

A further object of the present invention is to provide a high frequency sound total dispersion system comprising, a housing, four panels pivotally mounted to said housing at locations symmetrically dispersed about a center of said housing at an angle to said housing, a tweeter loudspeaker mounted in each panel, an adjustment means connected between said housing and said panels for varying said angles whereby normally directional high frequency sound can be totally dispersed within an area.

A still further object of the present invention is to provide a high frequency sound total dispersion system which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its usage, reference should be had to the accompanying drawings and descriptive matter in which there is illustrated a preferred embodiment of the invention.

BRIEF DESCRIPTION OF THE DRAWINGS

FIG. 4 is a front perspective view of another embodiment of the invention whereby the incline of the tweeter loudspeaker panels can be adjusted.

FIG. 5 is a side cross-sectional view of a detail of the adjustment means

FIG. **6*a*** is a plan view of a room using the inventive structure.

FIG. **6*b* is a view like FIG. 6*a*** in another room.

DESCRIPTION OF PREFERRED EMBODIMENTS OF THE INVENTION

The wavelength of a sound frequency is given by the relationship:

$$A=c/f$$

where,

A=wavelength in feet c=speed of sound in air (about 1100 feet/sec)

f=frequency in hertz

From this relationship the wavelength of a low frequency, such as 100 hertz, is found to be about 10 feet. Since this is a relatively long wavelength it will diverge at a wide angle as it radiates from a loudspeaker and disperse evenly throughout a room. Additionally, the effect of diffraction will cause long wavelengths to bend around large objects such as furniture and people.

In contrast, high frequencies over 3000 hertz will have wavelengths under 3 inches which radiate in a relatively narrow beam and will not diffract around large objects. This acoustic phenomena is responsible for the poor dispersion characteristic of high frequencies.

Figure 1:
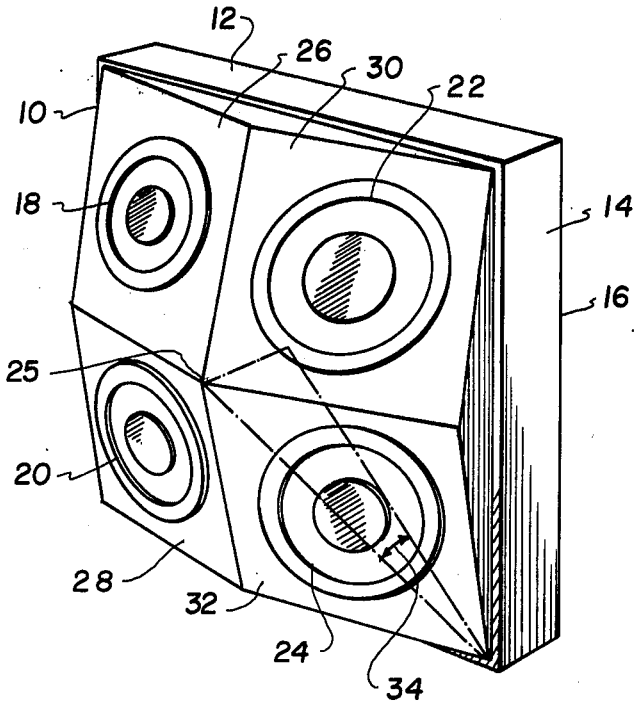
FIG. 1 is perspective view of a first embodiment of the invention showing a loudspeaker grouping with four or more tweeter loudspeakers inclined from the center of the front section of the high frequency unit.

In the drawings, FIG. 1 illustrates a first embodiment of the invention utilizing four tweeter loudspeakers. A housing 10 is comprised of a front section 25, sidewalls 14, and a rear planar wall 16 opposite to the front section 25. In the front section 25 are four tweeter loudspeakers 18, 20, 22, 24 mounted respectively on panels 26, 28, 30 and 32. Each of these panels are inclined outwardly from the center 25 of the front section. It has been found that the optimum inclination angle 34 between the panels and a plane in parallel to the rear planar wall 16 is in the range of 20 degrees to 30 degrees, with a preferred average angle of 25 degrees.

With an inclination angle of 25 degrees, the loudspeakers radiate sound both forward and vertically and horizontally as well as angularly. Since this primary wave impinges on the room surfaces at an oblique angle, multiple reflections are produced which diffuse the sound throughout the room.

In addition, it has been found that an inclination angle of about 25 degrees will minimize sound wave cancellations due to interference patterns so that sound intensity is maintained at a relatively even level throughout an average room depending on size and dispersion characteristic of woofer used in combination with this high frequency unit. For example, with very large woofer designed for wide dispersion, the high frequency unit would require a 30° angle for each of the component speakers and conversely medium size woofer require angle of 25° with smaller woofer sizes 22½° or even 20° angles would be more suitable so as to match the dispersion characteristics of both low and high frequency ranges.

In order to match the dispersion characteristics of the low frequency speakers used with this high frequency unit adjustment of the acute angle (between 20° to 30°) would be achieved by means of pivot or hinged portion of the mounting surface controlled by an adjusting device.

Figure 2:
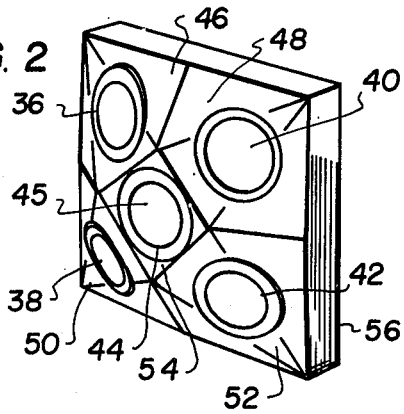
FIG. 2 is a perspective view of a second embodiment of the invention showing four inclined tweeter loudspeakers and one centrally located tweeter loudspeaker that is mounted in parallel with respect to the rear planar wall of the enclosure.

A second embodiment of the invention is depicted in FIG. 2. This is basically the same enclosure as in FIG. 1 except that a fifth tweeter loudspeaker 44 has been added in a center panel 54 that is parallel to the rear planar wall 56. It should be noted that the previous rhomboidal panels now have a pentagonal shape which does not affect the ratio of loudspeaker size to enclosure size appreciably.

Although four tweeter loudspeakers together will produce an adequate sound vector in the forward direction for an average size room, it has been found that for relatively large rooms the fifth loudspeaker may provide improved sound dispersion.

Figure 3:
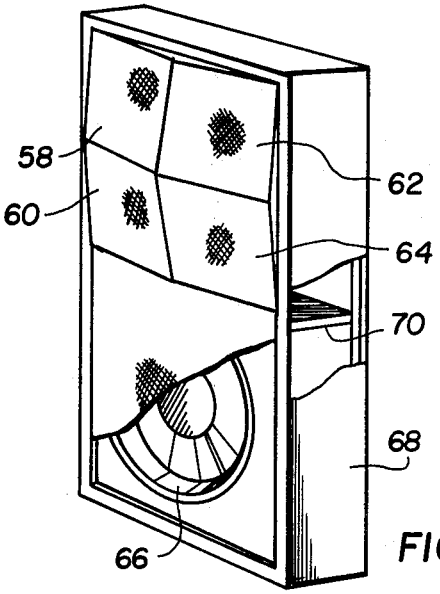
FIG. 3 is a perspective view showing the present invention in combination with a woofer loudspeaker.

For a compact total sound system the tweeter section may be combined with the woofer 66 into a single enclosure 68 as illustrated in FIG. 3. If open type tweeters are utilized then a divider section 70 may be used to separate the two sections of the enclosure. However, if closed-back type of tweeters are used, then the divider 70 may be removed for greater flexibility in choosing a woofer loudspeaker.

It should be noted that all tweeter loudspeakers may be connected in "parallel" or in "series parallel", depending upon the driver-amplifier used.

According to another embodiment of the present invention, and referring specifically to FIG. 4 where similar elements are designated with similar numbers having a prime. A housing 10' is shown which includes sidewalls 14' and a rear planar wall 16'. A front section 25' includes four panels 26', 28', 30', and 32'. Each panel is hinged adjacent its outside corner to the housing 10 by hinges 126, 128, 130, and 132 respectively. An adjustment means in the form of a knob having a threaded stem is threaded into housing 10 and rotatable to vary the angle 34' which indicates the incline of each panel with respect to a plane parallel to the backwall 16'.

Referring now to FIG. 5 adjustment means they comprise the knob 100 which has a top flange portion 102 that abuts against the inside corners of the panels 26', 28', 30' and 34'. A bottom flange 104 is connected to the knob 100 through a bridge 108. A threaded stem 110 is threaded into a block 112 connected to the interior of housing 10'. By rotating knob 100 threaded stem 110 is advanced and withdrawn from block 112 thus varying the angle 4' of respective panels. As can be seen from FIGS. **6*a* and 6*b*, the angle can be selected to totally disperse sound within rooms depending upon their shape. FIG. 6*a* for example shows a long rectangular room having two inventive speakers mounted at one end thereof. In this case a shallow angle for 34' is chosen so that the normally directional high frequency sound fully disperses within the room as indicated by the dot dash lines. As shown in FIG. 6*b* a square room with the speakers mounted on one side thereof can be fully saturated with sound by choosing a steeper angle for the angle 34'**.

While specific embodiments of the invention have been shown and described in detail to illustrate the application of the principles of the invention, it will be understood that the invention can be embodied otherwise without departing from such principles.

What is claimed is:

1. A high frequency sound dispersion system comprising:

a housing having a front section with at least four interconnected non-isoplanar panels mounted symmetrically about the center of said front section;

sidewalls, and a rear planar wall opposite to said front section;

at least one tweeter loudspeaker mounted in each of said front section panels;

at least four of said non-isoplanar panels are inclined at an acute angle with respect to a plane parallel with said rear planar wall, each of said inclined panels sloping away from the center of said front section and, wherein each of said panels is pivotally mounted to said housing; and adjustment means connected between said housing and each of said panels for varying said acute angle whereby a total dispersion of normally directional high frequency sound is affected.

2. A high frequency sound dispersion system according to claim 1 wherein said adjustment means comprises a threaded stem threaded into said housing and top and bottom flange portions connected to said threaded stem having at least a portion of each of said panels disposed between said top and bottom flange portion whereby said acute angle is varied.

3. A high frequency sound dispersion system according to claim 2 wherein said threaded stem further includes a knob disposed outside of said housing which is rotatable through said threaded stem into and out of said housing to vary said acute angle.

* * * * *